US012501996B2

(12) United States Patent
McMillan et al.

(10) Patent No.: US 12,501,996 B2
(45) Date of Patent: Dec. 23, 2025

(54) ADJUSTABLE LEG FOR FURNITURE

(71) Applicant: Resero IP Limited, Hamilton (NZ)

(72) Inventors: Peter Leslie James McMillan, Hamilton (NZ); Kenneth William Payne, Hamilton (NZ)

(73) Assignee: RESERO IP LIMITED, Hamilton (NZ)

( * ) Notice: Subject to any disclaimer, the term of this patent is extended or adjusted under 35 U.S.C. 154(b) by 0 days.

(21) Appl. No.: 18/685,531

(22) PCT Filed: Aug. 24, 2022

(86) PCT No.: PCT/NZ2022/050110

§ 371 (c)(1),
(2) Date: Feb. 22, 2024

(87) PCT Pub. No.: WO2023/027597

PCT Pub. Date: Mar. 2, 2023

(65) Prior Publication Data

US 2024/0349884 A1 Oct. 24, 2024

(30) Foreign Application Priority Data

Aug. 25, 2021 (AU) ..... 2021221693

(51) Int. Cl.
*F16M 13/00* (2006.01)
*A47B 9/20* (2006.01)
*A47C 3/40* (2006.01)

(52) U.S. Cl.
CPC . *A47B 9/20* (2013.01); *A47C 3/40* (2013.01)

(58) Field of Classification Search
CPC ..... A47B 9/20; A47B 9/14; A47B 2009/145; A47B 21/02; A47B 2200/0052; A47B 41/02; A47C 3/40
See application file for complete search history.

(56) References Cited

U.S. PATENT DOCUMENTS 453,094 A * 5/1891 Taylor ..... B62H 7/00 280/304
3,870,278 A * 3/1975 Lee ..... B66F 1/04 248/354.3

(Continued)

FOREIGN PATENT DOCUMENTS

AU 2016202281 A1 11/2016
CN 213405305 6/2021
JP H0533952 A 2/1993

OTHER PUBLICATIONS

PCT Search Report in related PCT Application No. PCT/NZ2022/050110, mailed Oct. 24, 2022.

*Primary Examiner* — Amy J. Sterling

(74) *Attorney, Agent, or Firm* — Thomas | Horstemeyer, LLP

(57) ABSTRACT

The present invention provides an inexpensive adjustable leg for furniture that can be used to alter the height of items of furniture, such as tables and desks used in education facilities, to accommodate persons of a wide range of height and ages. The adjustable leg comprises an outer sleeve within which an inner leg is slidably disposed. A protrusion provided to the interior of the outer sleeve interacts with a groove and recesses, corresponding to desired height settings, configured in the inner leg. A biasing member provided to the adjustable leg acts against a surface of the inner leg while mounted to the outer sleeve, urging the inner leg against the protrusion and facilitating easy engagement with the recesses.

18 Claims, 6 Drawing Sheets

(56) References Cited

U.S. PATENT DOCUMENTS

| | | | | |
|---|---|---|---|---|
| 6,138,973 | A * | 10/2000 | Woodward | B63B 29/06 248/188.5 |
| 9,239,126 | B2 * | 1/2016 | Adamson | F16M 11/046 |
| 2014/0283715 | A1 | 9/2014 | Sevadjian | |

* cited by examiner

ADJUSTABLE LEG FOR FURNITURE

CROSS REFERENCE TO RELATED APPLICATIONS

This application is the 35 U.S.C. § 371 national stage application of PCT Application No. PCT/NZ2022/050110, filed Aug. 24, 2022, which application claims the benefit of Australian Application No. 2021221693 filed Aug. 25, 2021, both of which are hereby incorporated by reference herein in their entireties.

TECHNICAL FIELD

The present invention relates to furniture, and in particular to furniture, such as tables, which have adjustable legs.

BACKGROUND ART

Furniture such as tables can require adjustable legs for two reasons. The first is to allow for a small adjustment to adapt the table for use over uneven surfaces such as may occur at cafes having settings on the footpath or sidewalk. The second is allow for the height of the furniture to be adapted for users of differing sizes or ages.

Many tables with adjustable legs utilise a telescopic arrangement with an inner leg that is slidable relative to an outer sleeve or leg. Often the respective inner leg and outer sleeve are provided with co-operative fittings, such as detents, to set the leg height. Examples of such arrangements are disclosed in United States Published Patent Application No. 2004/0194678. More complex arrangements are described in U.S. Pat. Nos. 5,755,164 and 6,092,771. However, these have drawbacks in cost of manufacture.

Furthermore, the arrangements of the prior art are not straightforward for users to operate. Often it can be difficult to manipulate the inner leg into the movement required to articulate it relative to the outer sleeve in order to set a preferred height.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

DISCLOSURE OF THE INVENTION

According to one aspect of the present invention there is provided an adjustable leg for an article of furniture, said adjustable leg comprising:

an outer tubular sleeve having an inwardly projecting protrusion;

an inner leg having an inner leg longitudinal axis, wherein said inner leg is dimensioned to be able to be telescopically received within said sleeve, be slidable along said sleeve, and be rotatable through an arc about said inner leg longitudinal axis, and said inner leg has a single, substantially straight groove which is longitudinally aligned with, and extends along, said leg and faces said protrusion, with said protrusion being engaged with said groove, said groove having a plurality of spaced apart recesses located to and leading from one side of said groove, whereby rotating said inner leg in one direction locates said protrusion in a recess to thereby set the position of said inner leg relative to said sleeve, and rotating said inner leg in the opposite direction aligns said protrusion with said groove, thereby permitting said inner leg to be slid along said sleeve with said protrusion engaged and sliding along said groove, and wherein said inner leg includes a biasing surface;

a biasing member, wherein the biasing member has a first end connected to the outer tubular sleeve and a second end which contacts and applies a rotational force to the biasing surface of the inner leg.

According to a second aspect of the present invention there is provided a method of adjusting an adjustable leg, said adjustable leg substantially as described above, wherein the method comprises the steps of:

a) rotating said inner leg relative to said outer sleeve in an arc about the longitudinal axis of said inner leg and in a first direction to engage said protrusion with said groove thereby apply a biasing force to the biasing member;

b) sliding said inner leg longitudinally relative to said outer sleeve to move said groove relative to said protrusion whilst maintaining said engagement; and c) allowing said biasing force to rotationally urge said inner leg relative to said outer sleeve in an arc about the longitudinal axis of said inner leg and in a second direction opposite to said first direction to engage said protrusion in one of said recesses.

The present invention provides an inexpensive adjustable leg for furniture that can be used to alter the height of items of furniture, such as tables and desks used in education facilities, to accommodate persons of a wide range of height and ages. Reference to the use of the invention throughout the remainder of the present specification is in respect of a table. However, it will be appreciated by persons skilled in the art that the present invention may also be used with other items of furniture. Non-limiting examples of other such items include chairs and stools.

The adjustable leg of the present invention comprises an outer sleeve, an inner leg and a biasing member.

The outer sleeve should be understood to be formed as a hollow tubular member having a circular internal cross-sectional profile.

Preferably, the outer sleeve is an extrusion of metal, such as steel or another metal or metal alloy recognized by a skilled addressee as being suitable for use in the present invention.

The outer sleeve has an upper end and a lower end.

Preferably, the inwardly projecting protrusion of the outer sleeve has been formed as a lug or similar that has been stamped or otherwise worked into the outer sleeve. In alternative embodiments, the lug may be welded into the outer sleeve.

Preferably, the lug is proximate the lower end of the outer sleeve.

The outer sleeve includes a mounting point for the biasing member. Preferably, the mounting point is a crossbar at or proximate the upper end of the outer sleeve, the crossbar substantially spanning the profile of the outer sleeve. The crossbar may be welded into place or alternatively formed as part of the outer sleeve. In alternative embodiments, the outer sleeve may be provided with an external member that serves as the mounting point. In other embodiments, the mounting point may be in the form of recesses or cutouts provided to the outer sleeve, which engage with complementary features provided to the biasing member.

The inner leg should be understood to be formed as a hollow tubular member having a circular external cross-sectional profile.

Preferably, the inner leg is formed as a moulding of plastics material, such as polypropylene or another suitably durable and hardwearing type of plastic. In some examples, the inner may be an extrusion of metal, such as aluminium or the like.

The inner leg has an upper end and a lower end.

Preferably, the inner leg includes a one-way ramp at its upper end for the protrusion of the outer sleeve.

Preferably, the inner leg includes a foot at its lower end. In some examples, the inner leg may alternatively include a castor wheel or similar at its lower end.

Preferably, the biasing surface is provided to the interior of the inner leg.

Preferably, the biasing surface is in the form of a channel running the longitudinal axis of the inner leg.

Even more preferably, the biasing surface is opposing channels running the inner leg longitudinal axis.

The biasing member should be understood to be a component of spung metal configured to engage with the mounting point of the outer sleeve and with the inner leg.

Preferably the biasing member is placed under tension/bias by deforming, for example by bending or twisting, a first portion of the biasing member relative to a second portion of the biasing member. This imparts a pre-load force to the biasing member.

Preferably, the biasing member is a torsion wire spring, wherein the spring has a first end and a second end.

Preferably, the first end of the biasing member engages and/or connects to the biasing surface of the inner leg.

Preferably, the second end of the biasing member engages and/or connects to the mounting point of the outer sleeve.

Preferably, the second end of the biasing member is rotated or twisted relative to the first end of the biasing member before it is engaged and/or connects with the mounting point, thereby imparting a tensioning/biasing force to the biasing member.

Preferably, the second end of the biasing member is configured as a loop head, wherein the head includes a lateral wing and a neck. Even more preferably, the head includes opposing lateral wings and a neck. In some examples, the wing or wings may be reinforced with plastic fittings to increase their surface area.

Preferably, the lateral wing engages with the channel of the biasing surface. Even more preferably, the opposing lateral wings engage with the opposing channels.

Preferably, the loop head includes a open hook that engages with the neck of the loop head.

Preferably, the item of furniture with which the present invention is used is a table. However, in other non-limiting examples, the item of furniture may be a desk, chair, stool or stand.

The invention is particular advantageous in providing items of furniture such as a table with functionality to allow the height of its working surface to be easily adjusted as required. This means that the same item of furniture may be able to cater for people of different ages and/or height as required. For example, the same table may be used by adult students and children simply by adjusting the legs.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

One example of an embodiment of the invention in the form of an adjustable leg (generally indicated by arrow 100) for a table shall now be described.

Figure 1:
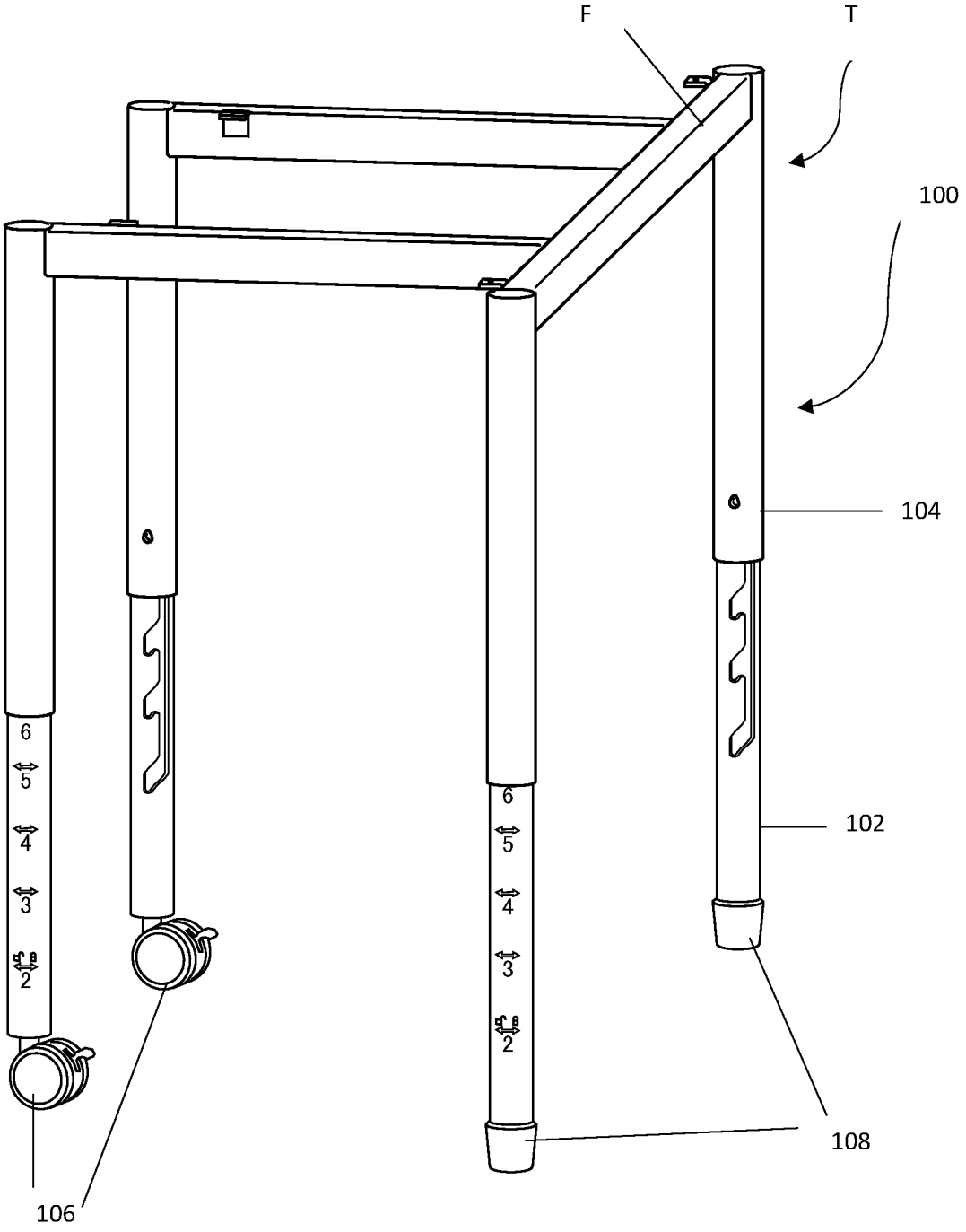
FIG. 1 is a perspective view of a table fitted with one embodiment of the adjustable leg.

FIG. 1 shows a table T, with its top omitted for sake of clarity. The table includes a plurality of adjustable legs 100, four in total; each leg comprises of an inner leg 102 slidably received within an outer sleeve 104 that depends downwards from the frame F, which in use bears the table top (not shown). To assist in maneuverability, two of the inner legs bear castor wheels 106 at their lower ends to allow the table to be moved as required. The lower ends of the other two inner legs are provided with a foot 108 formed of polypropylene or similar plastics material or alternatively be formed of rubber or other elastomeric material.

Figures 2A, 2B:
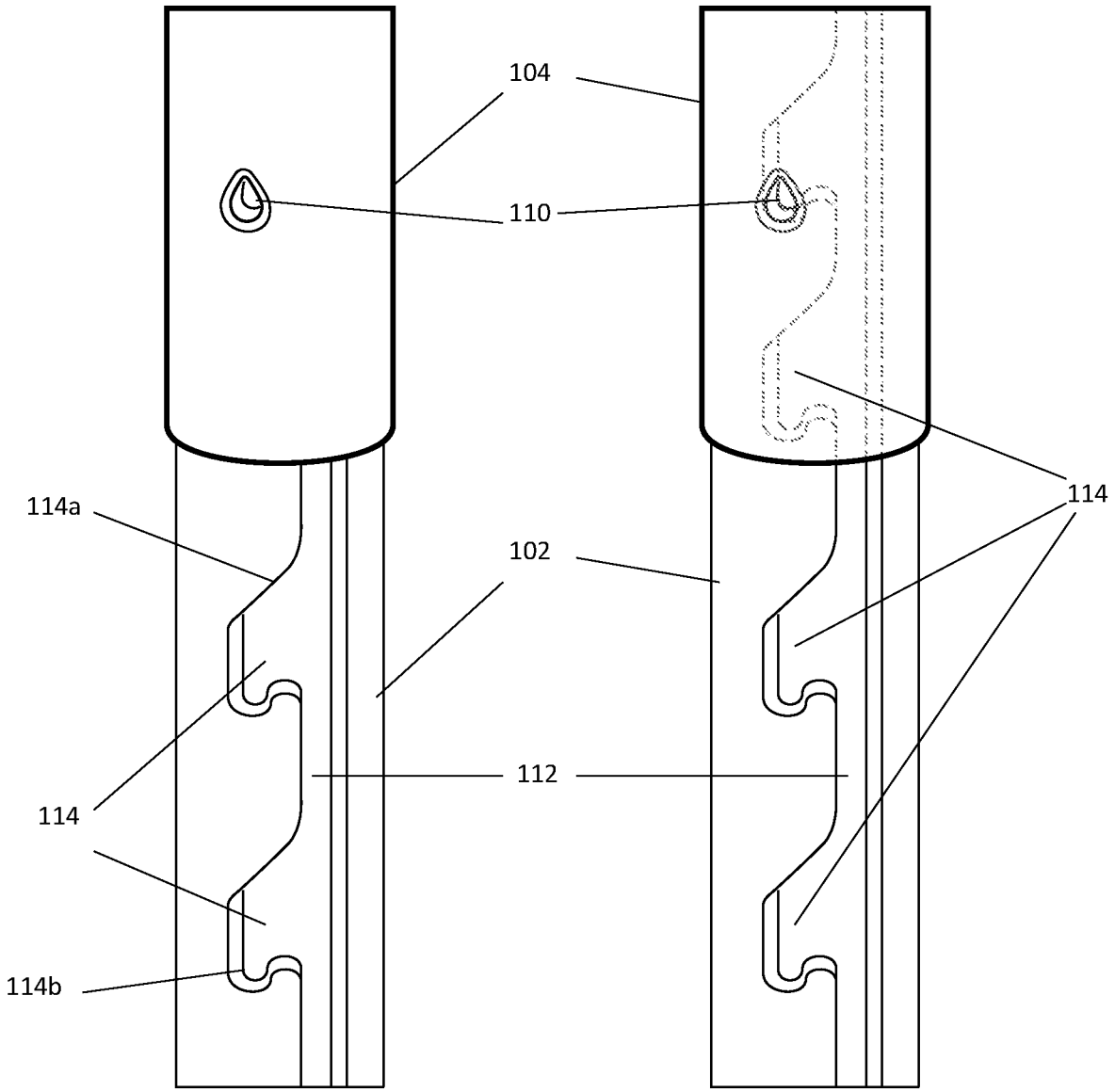
FIG. 2A is a close up perspective view of the inner and outer sleeve of the adjustable leg of FIG. 1.
FIG. 2B is a second close up perspective view of the inner and outer sleeve of FIG. 2A, in which the outer sleeve has been rendered transparent.

Turning to FIGS. 2A and 2B, the inner leg 102 and outer sleeve 104 are illustrated in a closer view; in the latter figure, the outer sleeve has been made semi-transparent.

The outer sleeve 104, formed from a hollow tubular extrusion of metal, such as steel or another suitable metal or metal alloy, is substantially circular in cross-section. A lug 110, created in this example by a stamping process during manufacture, forms a protrusion that extends inwardly, into the interior of the outer sleeve. This lug is positioned proximate the lower end of the outer sleeve. It will be appreciated that the outer sleeve needs to be provided with sufficient surface area below the lug to ensure adequate contact with the inner leg.

In this example, the inner leg 102 is a moulding of plastics material such as polypropylene which includes reinforcing elements for added structural integrity. Persons skilled in the art will appreciate that other types of plastics material may be used and in some instances, the inner may be formed from an extrusion of metal.

The inner leg 102 has an external cross-sectional profile that is substantially complementary to the internal cross-sectional profile of the outer sleeve 104. As can be seen, the inner leg is configured with a groove 112 extending vertically along the longitudinal axis of the inner leg. Extending substantially laterally from the groove are provided a series of spaced apart recesses 114.

As will be appreciated, the groove 112 and recesses 114 of the inner leg 102 interact with the lug 110 of the outer sleeve 104. The upper edge 114*a* of the recesses are contoured to create a smooth path of travel for the lug as it traverses the groove and recesses.

Each recess 114 corresponds to a specific height setting for the table. When the lug 110 is opposite the desired recess, rotating the inner leg 102 about its longitudinal axis to engage the lug with the recess sets the height of the table. The lower edge 114*b* of the recesses defines a pocket that locates and bears the lug, and therefore the weight of the table. The reverse of this rotational movement disengages the lug from the recess, moving it into the groove 112; this allows the lug to move vertically along the groove if desired, for example to allow a new height for the table to be set.

Figure 3:
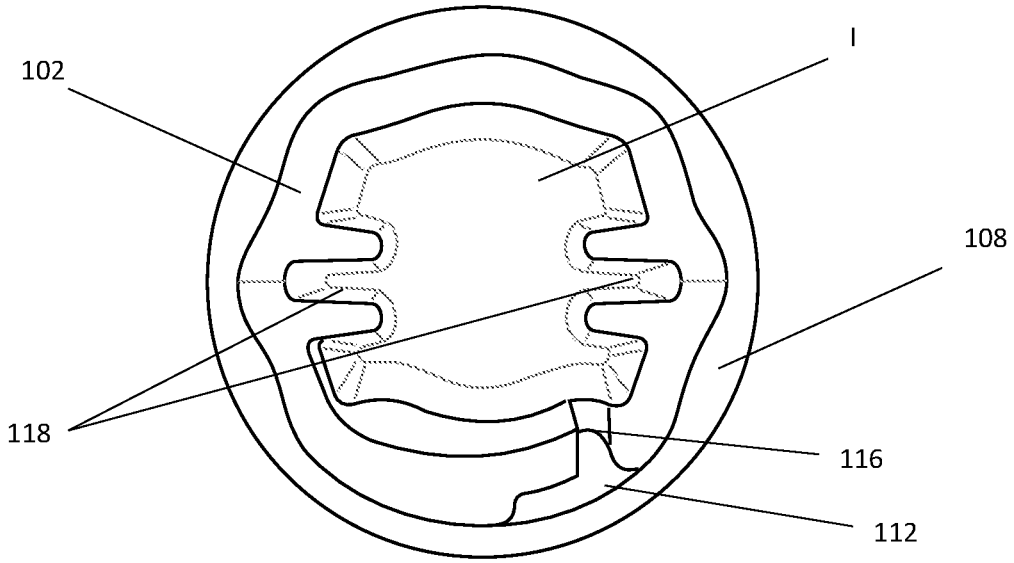
FIG. 3 is a top view of the inner leg of FIGS. 2A and 2B.

Turning to FIG. 3, a top view of the inner leg 102, it can be seen that the interior I of the inner leg is substantially hollow, although closed off at the bottom because of the presence of the foot 108. For moulding purposes, the interior of the leg gradually tapers inwards, such that the internal cross-sectional profile is greater at the top than it is at the bottom, even though the external cross-sectional profile may be substantially consistent along the entire length of the inner leg.

Also visible in FIG. 3 is a deformable one-way ramp 116 at the top of the groove 112. This allows the inner leg 102 to be inserted into the outer sleeve (not shown in FIG. 3), from the lower end, when assembling the adjustable leg. The lug (not shown) of the outer sleeve engages and deforms the one-way ramp as it traverses over it. However, once it has moved over the ramp and settled into the groove, the inner leg is unable to be extracted from the outer sleeve; the ramp has been deformed such that the lug cannot travel back over it and the inner leg cannot be separated from the outer sleeve.

The interior of the inner leg 102 is provided with two opposing channels 118 are provided to the interior I which extend substantially from the top to bottom of the inner leg. In use, these channels form a biasing surface for the biasing member (not shown in FIG. 3) of the adjustable leg. Having a pair of channels is preferred since this increases the surface area of the biasing surface.

Figure 4:
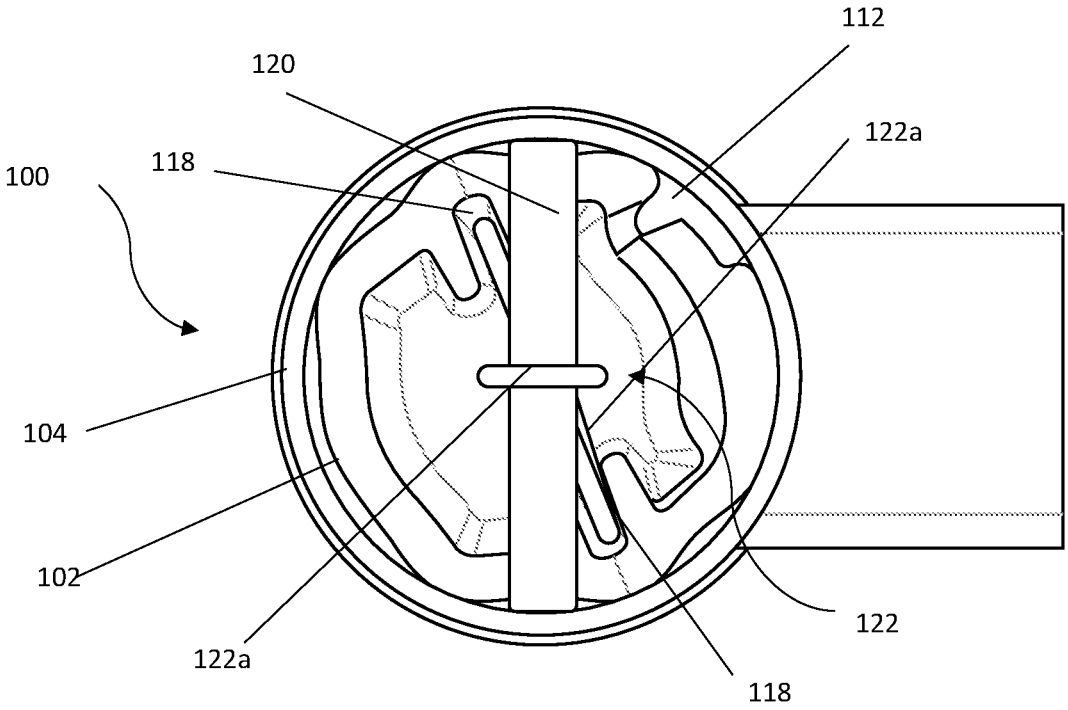
FIG. 4 is a top view of the inner leg of FIG. 3 disposed within the outer sleeve of FIGS. 2A and 2B.

As seen in FIG. 4, which is a top view of the adjustable leg 100, the inner leg 102 fits snugly within the interior profile of the outer sleeve 104. The range of vertical and lateral movement of the inner leg relative to the outer sleeve is limited to the groove 112 and recesses (not visible), which provides a pathway for the lug (not visible) of the outer sleeve.

At the upper end of the outer sleeve 104, a mounting point, which in the illustrated example is in the form of a crossbar 120, is provided, spanning the interior profile of the outer sleeve. The crossbar serves as an anchor point for the biasing member 122, the upper end 122*a* of which hooking over the crossbar and the other end 122*b* engaging with the opposing channels 118 of the inner leg 102. When the biasing member is engaged with these channels, it provides constant torque to the biasing surface, urging the inner leg to rotate relative to the outer sleeve. In the illustrated example, this torque is applied in an anti-clockwise direction.

Figure 5A:
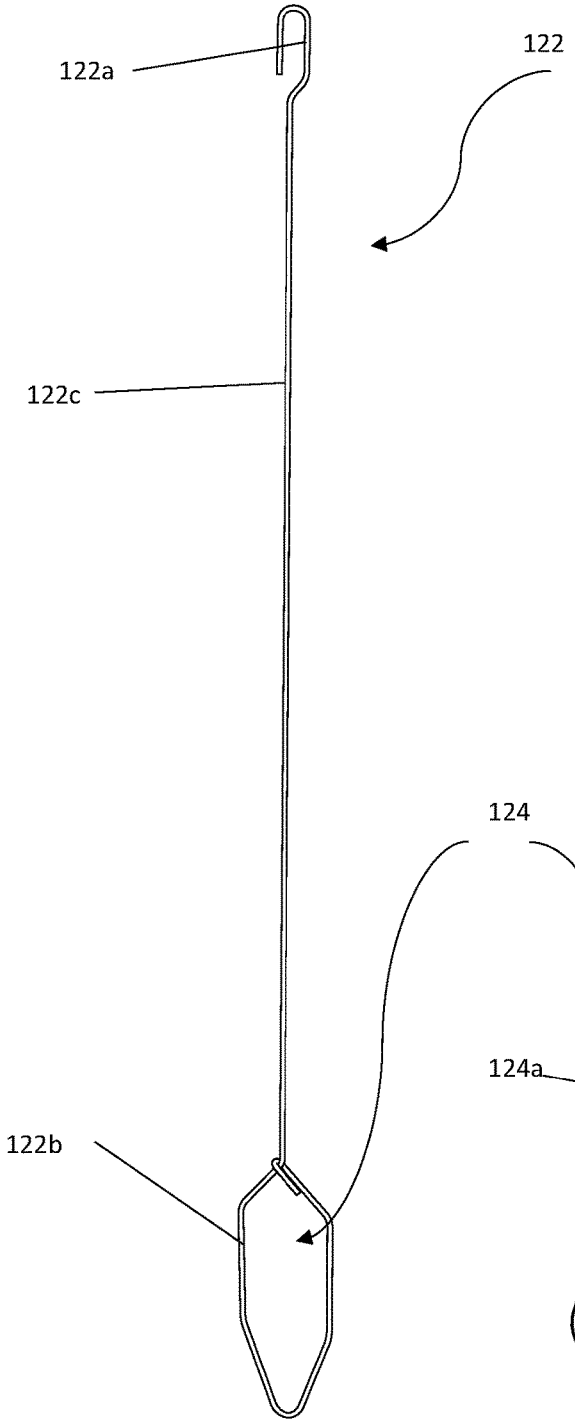
FIG. 5A is a perspective view of the biasing member of the adjustable leg.
Figure 5B:
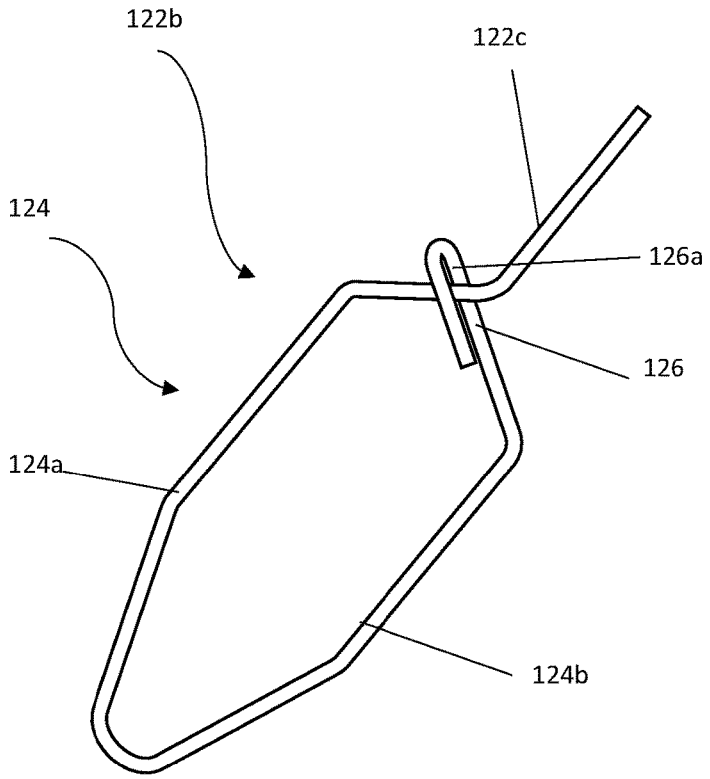
FIG. 5B is a close up perspective view of the head of the biasing member of FIG. 5A.

The biasing member 122 in this example is a torsion wire spring, as shown in FIGS. 5A and 5B. It has an upper end 122*a*, an elongate shaft portion 122*c*, and a lower end 122*b*. The upper end is fashioned as a hook which, in use, engages with the crossbar of the outer sleeve (not shown in FIGS. 5A and 5B). The lower end of the spring is configured as a loop head 124, formed by bending the lower end of the spring back upon itself. Either side of the head forms opposing wings 124*a*, 124*b*. These wings engage with the opposing channels of the interior of the inner leg (not shown in FIGS. 5A and 5B).

The very tip of the lower end of the spring is bent to form a hook 126 that wraps around the shaft 122*c* of the spring, as best seen in FIG. 5B. It will be recalled that the interior of the inner leg (not shown in FIGS. 5A and 5B) gradually tapers inwards. This will cause some deformation of the wings of the head as these advance deeper into the interior of the inner leg, which occurs as the inner leg slides into the outer sleeve (not shown in FIGS. 5A and 5B). To compensate for this deformation, the hook is formed with a relatively deep recess 126*a*. This permits a degree of deformation of the opposing wings 124*a*, 124*b* as the inner leg slides longitudinally within the outer sleeve.

Figure 6:
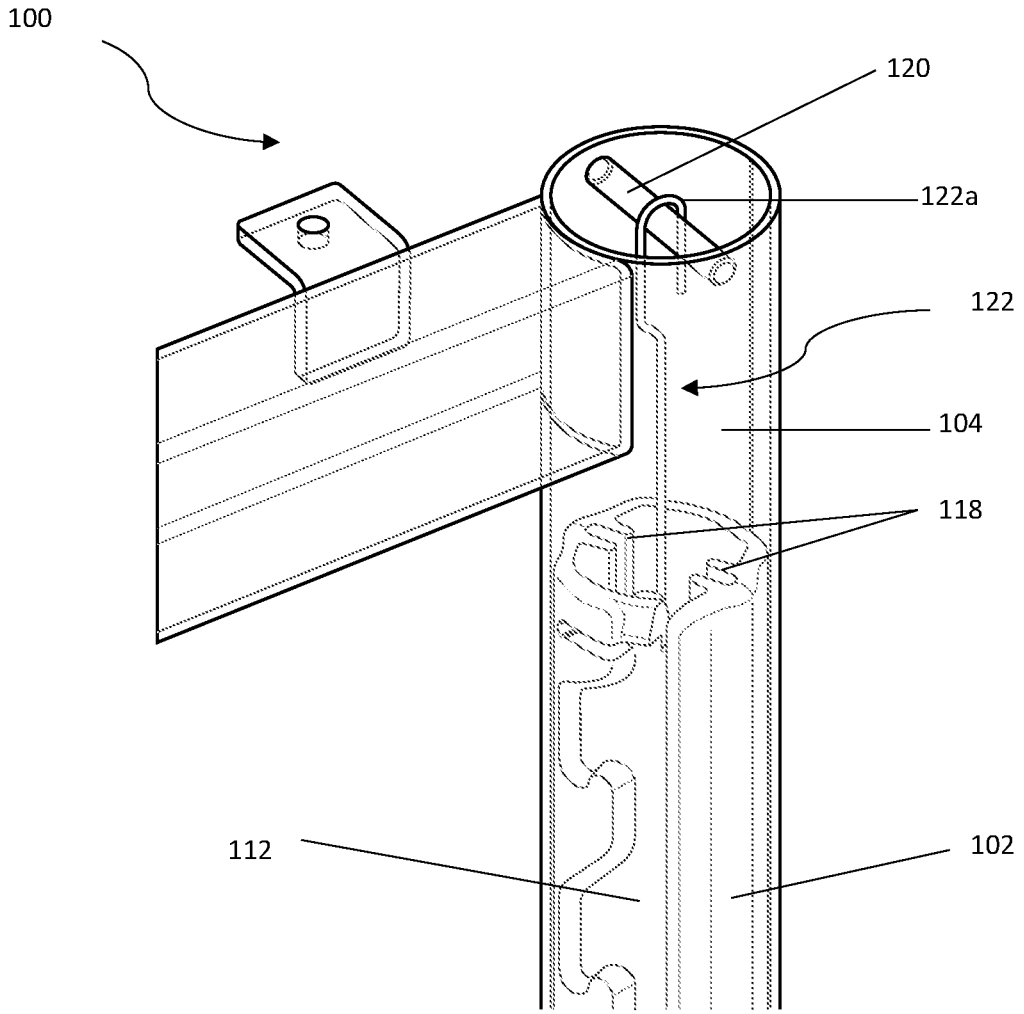
FIG. 6 is a close up perspective view of the inner leg, outer sleeve and biasing member.

In FIG. 5A it will be seen the hook of the upper end 122*a* and the wings of the lower end 124*a*, 124*b* are substantially in the same plane. Now referring to the adjustable leg 100 FIG. 6, it will be seen that the crossbar 120 of the outer sleeve 104 and the channels 118 of the inner leg 102 are also in the same plane. When the biasing member 122 is inserted from the upper end of the outer sleeve, the wings of the lower end of the biasing member are inserted into the respective channels of the inner leg. The hook 122*a* at the upper end of the biasing member must be fitted to the crossbar. In order to do so, it is necessary to twist the hook substantially before it can be slipped it over the crossbar.

This twisting action applies a torque or biasing force to the spring 122 which, via the wings (not visible in FIG. 6) is transferred to the channels, i.e. biasing surfaces 118 of the inner leg 102. In this manner, the inner leg is under a constant force that urges the lug (not visible in FIG. 6) to bear against the side of the groove 112 from which the spaced apart recesses extend.

Figure 7A:
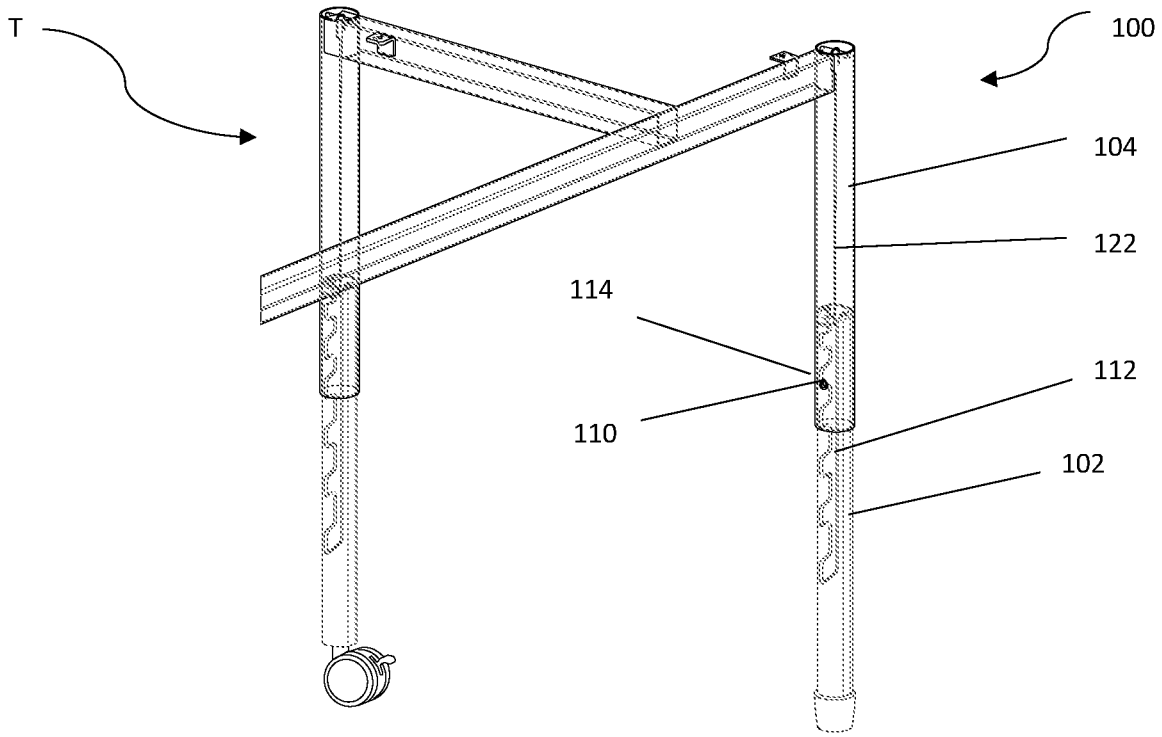
FIG. 7A is a perspective view of the adjustable leg in a first position.
Figure 7B:
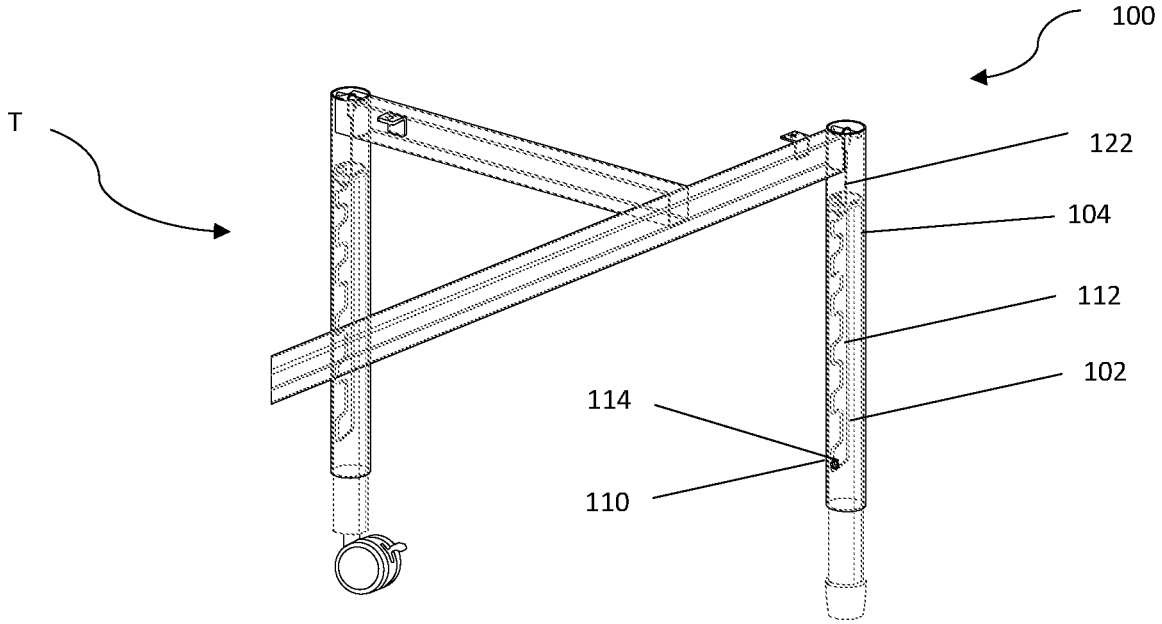
FIG. 7B is a perspective view of the adjustable leg in a second position.

It should be appreciated that there may be some variance in the architecture of the spring and the manner in which it engages with the outer sleeve and inner leg. For example, this may depend on the choice of wire that is used for the spring, which may require more or less torque to be applied before a sufficient amount of pre-load force is imparted. This may mean relatively little To adjust the height of the table T from the relatively high setting as depicted in FIG. 7A, which may be more suitable for adults or teenagers, to a low setting as in FIG. 7B, suitable for young children, the user twists or otherwise rotates the inner leg 102 relative to the outer sleeve 104. To do so, they are required to exert sufficient force to overcome the inherent bias of the biasing member 122. This twisting movement moves the lug 110 from an engagement with the recess 114 into the groove 112. The vertical height of the adjustable leg 100 is then lowered, the lug of the outer sleeve being able to traverse the groove of the inner leg accordingly. Once the desired height has been reached, the user simply releases their hold on the inner leg. The biasing member rotationally urges the inner leg side of the groove, from which the recesses extend, against the lug. This may place the lug directly into the appropriate recess corresponding to the desired height or a gentle pulling or pushing force may be exerted by the user to guide the lug into the nearest recess.

The actions required to adjust the leg 100 are relatively intuitive and quick to learn, even for children. This process may be aided through the use of markings (not shown) provided to the exterior surface of the outer sleeve 104 and/or inner leg 102 to help provide users an indication of the location of the recesses 114.

The present invention provides an intuitive, easy-to-use adjustable leg for furniture, such as a table, that allows it to be quickly adapted for different users. It is not just convenient for single tables but also in situations where there are several tables, such as in a classroom setting where several different student age groups may use the same tables at different times. The tables can be quickly altered in height in between each group as required. Although the example as described herein refers to a table, it will be appreciated that this is not intended to be limiting and the invention may be used with other items of furniture such as desks, chairs, stands for electronic equipment and the like.

The invention may also be said broadly to consist in the parts, elements, characteristics and features referred to or indicated in the specification of the application, individually or collectively, in any or all combinations of two or more of said parts, elements, characteristics or features.

Aspects of the present invention have been described by way of example only and it should be appreciated that modifications and additions may be made thereto without departing from the scope thereof as defined in the appended claims.

What we claim is:

1. An adjustable leg for an article of furniture, said adjustable leg comprising:

an outer tubular sleeve having an inwardly projecting protrusion;

an inner leg having an inner leg longitudinal axis, wherein said inner leg is dimensioned to be able to be telescopically received within said sleeve, be slidable along said sleeve, and be rotatable through an arc about said inner leg longitudinal axis, and said inner leg has a single, substantially straight groove which is longitudinally aligned with, and extends along, said leg and faces said protrusion, with said protrusion being engaged with said groove, said groove having a plurality of spaced apart recesses located to and leading from one side of said groove, whereby rotating said inner leg in one direction locates said protrusion in a recess to thereby set the position of said inner leg relative to said sleeve, and rotating said inner leg in the opposite direction aligns said protrusion with said groove, thereby permitting said inner leg to be slid along said sleeve with said protrusion engaged and sliding along said groove, and wherein said inner leg includes a biasing surface;

wherein the inner leg is formed as a hollow tubular member having a circular external cross-sectional profile and the biasing surface is provided to the interior of the inner leg;

a biasing member, wherein the biasing member has a first end connected to the outer tubular sleeve and a second end which contacts and applies a rotational force to the biasing surface of the inner leg.

2. The adjustable leg of claim 1, wherein the outer sleeve is formed as a hollow tubular extrusion having a circular internal cross-sectional profile.

3. The adjustable leg of claim 1, wherein the inwardly projecting protrusion is a lug or similar in the outer sleeve.

4. The adjustable leg of claim 1, wherein the outer sleeve includes a mounting point for the biasing member.

5. The adjustable leg of claim 1, wherein the biasing surface is in the form of a channel running the longitudinal axis of the interior of the inner leg.

6. The adjustable leg of claim 5, wherein the biasing surface is opposing channels running the longitudinal axis of the interior of the inner leg.

7. The adjustable leg of claim 1, wherein the inner leg has an upper end and a lower end.

8. The adjustable leg of claim 7, wherein the inner leg includes:

i) a one-way ramp at its upper end for the protrusion of the outer sleeve; and/or ii) a foot at its lower end.

9. The adjustable leg of claim 1, wherein the biasing member is a component of spung metal configured to engage with the outer sleeve and with the inner leg.

10. The adjustable leg of claim 9, wherein the biasing member is placed under tension/bias by deforming a first portion of the biasing member relative to a second portion of the biasing member.

11. The adjustable leg of claim 9, wherein the biasing member is a torsion wire spring and wherein the spring has a first end and a second end.

12. The adjustable leg of claim 11, wherein the first end of the spring engages and/or connects to the biasing surface of the inner leg.

13. The adjustable leg of claim 11, wherein the second end of the biasing member engages and/or connects to the mounting point of the outer sleeve.

14. The adjustable leg of claim 11, wherein the second end of the biasing member is configured as a loop head, wherein the head includes:

i) a lateral wing and a neck; or ii) opposing lateral wings and a neck.

15. The adjustable leg of claim 14, wherein at least one lateral wing engages with the biasing surface of the inner leg.

16. The adjustable leg of claim 14, wherein the loop head includes an open hook that engages with the neck of the loop head.

17. A method of adjusting an adjustable leg as claimed in claim 1, wherein the method comprises the steps of:

a) rotating said inner leg relative to said outer sleeve in an arc about the longitudinal axis of said inner leg and in a first direction to engage said protrusion with said groove thereby apply a biasing force to the biasing member;

b) sliding said inner leg longitudinally relative to said outer sleeve to move said groove relative to said protrusion whilst maintaining said engagement; and c) allowing said biasing force to rotationally urge said inner leg relative to said outer sleeve in an arc about the longitudinal axis of said inner leg and in a second direction opposite to said first direction to engage said protrusion in one of said recesses.

18. The method of claim 17, including the further step of:

d) during step b), stopping the sliding motion of the inner leg when the said protrusion engages with one or the recesses.

* * * * *